US009406988B2

(12) United States Patent
Hendry et al.

(10) Patent No.: US 9,406,988 B2
(45) Date of Patent: Aug. 2, 2016

(54) MULTI-MODE FILTER

(75) Inventors: David Robert Hendry, Brisbane (AU); Steven John Cooper, Brisbane (AU); Peter Blakeborough Kenington, Chepstow (GB)

(73) Assignee: Mesaplexx Pty Ltd, Queensland (AU)

( * ) Notice: Subject to any disclaimer, the term of this patent is extended or adjusted under 35 U.S.C. 154(b) by 266 days.

(21) Appl. No.: 13/592,982

(22) Filed: Aug. 23, 2012

(65) Prior Publication Data

US 2013/0049902 A1 Feb. 28, 2013

Related U.S. Application Data

(63) Continuation-in-part of application No. 13/531,169, filed on Jun. 22, 2012, and a continuation-in-part of application No. 13/531,084, filed on Jun. 22, 2012.

(60) Provisional application No. 61/531,277, filed on Sep. 6, 2011.

(30) Foreign Application Priority Data

Aug. 23, 2011 (AU) ..... 2011903389

(51) Int. Cl.
*H01P 1/208* (2006.01)
*H01P 7/10* (2006.01)

(52) U.S. Cl.
CPC ..... *H01P 1/2088* (2013.01); *H01P 7/105* (2013.01); *H01P 1/2082* (2013.01)

(58) Field of Classification Search
CPC . H01P 1/20309; H01P 1/2084; H01P 1/2086; H01P 7/105
USPC ..... 333/202, 219.1
See application file for complete search history.

(56) References Cited

U.S. PATENT DOCUMENTS 2,890,421 A 6/1959 Currie
3,657,670 A 4/1972 Kitazume et al. ..... 333/73 W (Continued)

FOREIGN PATENT DOCUMENTS

CA 1189154 A2 6/1985
CA 1194157 A1 9/1985

(Continued)

OTHER PUBLICATIONS

Awai, Ikuo, et al; Equivalent-Circuit Representation and Explanation of Attenuation Poles of a Dual-Mode Dielectric-Resonator Bandpass Filter; Transactions on Microwave Theory and Techniques; (Dec. 1998); pp. 2159-2163; vol. 46; No. 12; IEEE.

(Continued)

*Primary Examiner* — Robert Pascal
*Assistant Examiner* — Gerald Stevens
(74) *Attorney, Agent, or Firm* — Harrington & Smith

(57) ABSTRACT

A multi-mode cavity filter, comprising: a dielectric resonator body incorporating a piece of dielectric material, the piece of dielectric material having a shape such that it can support at least a first resonant mode and a second substantially degenerate resonant mode; a conductive layer substantially covering the dielectric resonator body but having one or more apertures therein allowing access to the dielectric resonator body; and a coupling structure arranged in an aperture of the one or more apertures, comprising at least one coupling path for at least one of coupling an input signal to the first and second resonant modes and coupling an output signal from the first and second resonant modes, the coupling path having an open-circuit end located adjacent to an edge of the aperture for controlling a strength of electric field generated by the coupling structure.

17 Claims, 5 Drawing Sheets

(56) References Cited

U.S. PATENT DOCUMENTS

| | | | | |
|---|---|---|---|---|
| 4,142,164 | A | 2/1979 | Nishikawa et al. | |
| 4,614,920 | A | 9/1986 | Tong | |
| 4,622,523 | A | 11/1986 | Tang | |
| 4,623,857 | A | 11/1986 | Nishikawa et al. | |
| 4,630,009 | A | 12/1986 | Tang | |
| 4,644,305 | A | 2/1987 | Tang et al. | |
| 4,675,630 | A | 6/1987 | Tang et al. | |
| 4,792,771 | A | 12/1988 | Siu | |
| 4,879,533 | A | 11/1989 | De Muro et al. | 333/206 |
| 4,963,844 | A | 10/1990 | Konishi et al. | 333/208 |
| 5,023,866 | A | 6/1991 | De Muro | 370/24 |
| 5,307,036 | A | 4/1994 | Turunen et al. | 333/202 |
| 5,325,077 | A | 6/1994 | Ishikawa et al. | 333/219.1 |
| 5,585,331 | A | 12/1996 | Mansour et al. | |
| 5,589,807 | A | 12/1996 | Tang | |
| 5,710,530 | A | 1/1998 | Wada et al. | |
| 5,731,751 | A | 3/1998 | Vangala | |
| 5,805,035 | A | 9/1998 | Accatino et al. | |
| 5,821,837 | A | 10/1998 | Accatino et al. | |
| 6,005,457 | A | 12/1999 | Wu | |
| 6,016,091 | A | 1/2000 | Hidaka et al. | 333/202 |
| 6,025,291 | A | 2/2000 | Murakawa | 501/136 |
| 6,066,996 | A | 5/2000 | Goertz et al. | |
| 6,072,378 | A | 6/2000 | Kurisu et al. | |
| 6,133,808 | A | 10/2000 | Arakawa | 333/134 |
| 6,160,463 | A | 12/2000 | Arakawa et al. | 333/202 |
| 6,278,344 | B1 | 8/2001 | Kurisu et al. | |
| 6,346,867 | B2 | 2/2002 | Arakawa et al. | 333/208 |
| 6,462,629 | B1 | 10/2002 | Blair et al. | |
| 6,549,094 | B2 | 4/2003 | Takagi et al. | 333/134 |
| 6,677,837 | B2 | 1/2004 | Kojima et al. | 333/208 |
| 6,762,658 | B1 | 7/2004 | Isomura et al. | 333/202 |
| 6,825,740 | B2 | 11/2004 | Kundu | 333/202 |
| 6,834,429 | B2 | 12/2004 | Blair et al. | |
| 6,853,271 | B2 | 2/2005 | Wilber et al. | |
| 6,897,741 | B2 | 5/2005 | Ando et al. | |
| 6,954,122 | B2 | 10/2005 | Wilber et al. | |
| 7,042,314 | B2 | 5/2006 | Wang et al. | 333/202 |
| 7,068,127 | B2 | 6/2006 | Wilber et al. | |
| 7,138,891 | B2 | 11/2006 | Andoh et al. | |
| 7,605,678 | B2 | 10/2009 | Ando et al. | |
| 7,755,456 | B2 | 7/2010 | Salehi | |
| 8,022,792 | B2 | 9/2011 | Howard | |
| 8,325,077 | B2 | 12/2012 | Gentric | 341/173 |
| 2001/0000429 | A1* | 4/2001 | Arakawa et al. | 333/208 |
| 2001/0024147 | A1 | 9/2001 | Arakawa et al. | 333/135 |
| 2002/0024410 | A1* | 2/2002 | Guglielmi et al. | 333/202 |
| 2002/0039058 | A1 | 4/2002 | Sano et al. | 333/202 |
| 2003/0006864 | A1 | 1/2003 | Hattori et al. | |
| 2003/0090344 | A1 | 5/2003 | Wang et al. | 333/202 |
| 2003/0141948 | A1 | 7/2003 | Maekawa et al. | |
| 2003/0227360 | A1 | 12/2003 | Kirihara et al. | 333/239 |
| 2004/0041660 | A1 | 3/2004 | Kawahara et al. | |
| 2004/0056736 | A1* | 3/2004 | Enokihara et al. | 333/202 |
| 2005/0128031 | A1 | 6/2005 | Wilber et al. | 333/202 |
| 2005/0140474 | A1 | 6/2005 | Kim et al. | 333/219.1 |
| 2005/0253672 | A1 | 11/2005 | Enokihara et al. | 333/219.1 |
| 2006/0139127 | A1 | 6/2006 | Wada et al. | 333/202 |
| 2008/0018391 | A1* | 1/2008 | Bates | 327/557 |
| 2008/0061905 | A1 | 3/2008 | Ishikawa | |
| 2008/0211601 | A1 | 9/2008 | Bates | 333/186 |
| 2010/0231323 | A1 | 9/2010 | Vangala et al. | |
| 2011/0006856 | A1 | 1/2011 | Kim et al. | |
| 2011/0128097 | A1 | 6/2011 | Park et al. | |
| 2014/0077900 | A1 | 3/2014 | Rogozine et al. | 333/212 |

FOREIGN PATENT DOCUMENTS

| | | | |
|---|---|---|---|
| EP | 0883203 | A3 | 10/1999 |
| JP | H0216801 | | 1/1990 |
| JP | H-10224113 | | 1/1998 |
| JP | H-10284988 | | 1/1998 |
| JP | H-1079636 | | 3/1998 |
| JP | H-10209808 | | 8/1998 |
| JP | H-10294644 | | 11/1998 |
| JP | H-10322161 | | 12/1998 |
| JP | 2000295072 | A | 10/2000 |
| JP | 2001060804 | A | 3/2001 |
| JP | 2001060805 | A | 3/2001 |
| JP | 2001160702 | A | 6/2001 |
| JP | 2002135003 | A | 5/2002 |
| JP | 2002151906 | A | 5/2002 |
| JP | 2002217663 | A | 8/2002 |
| JP | 2003037476 | A | 2/2003 |
| JP | 2003188617 | A | 7/2003 |
| JP | 2003234635 | A | 8/2003 |
| JP | 2004312287 | A | 11/2004 |
| JP | 2004312288 | A | 11/2004 |
| JP | 2005065040 | A | 3/2005 |
| JP | 2005167577 | A | 6/2005 |
| JP | 2005223721 | A | 8/2005 |
| WO | WO-9301626 | A1 | 1/1993 |
| WO | WO-0077883 | A1 | 12/2000 |
| WO | WO-02078119 | A1 | 10/2002 |

OTHER PUBLICATIONS

Awai, Ikuo, et al; Coupling of Dual Modes in a Dielectric Waveguide Resonator and its Application to Bandpass Filters; Proceedings of The 25th European Microwave Conference; (1995); pp. 533-537; Conf. 25; Yamaguchi University, Japan.

Weily, Andrew R, et al; Rotationally Symmetric FDTD for Fast Design and Wideband Spurious Performance Prediction of Dielectric Resonator Filters; Telecom Group, Faculty of Engineering, University of Technology; (1999); pp. 844-847.

Chaudhary, Raghvendra Kumar, et al.; Multi-Layer Multi-Permittivity Dielectric Resonator: A New Approach for Improved Spurious Free Window; Proceedings of The 40th European Microwave Conference; (Sep. 28-30, 2010); pp. 1194-1197; Paris, France.

Sano, Kazuhisa, et al.; Application of The Planar I/O Terminal to Dual Mode Dielectric Waveguide Filters; International Microwave Symposium Digest; (Jun. 11-16, 2000); pp. 1173-1176; Boston, MA.

Wang, Chi, et al; A Practical Triple-Mode Monoblock Bandpass Filter for Base Station Applications; MTT-S Digest; (2001); pp. 1783-1786.

Awai, Ikuo, et al; A Dual Mode Dielectric Waveguide Resonator and its Application to Bandpass Filters; IEICE Transactions on Electronics; (Aug. 1995); pp. 1018-1025; vol. E78-C; No. 8.

Bekheit, Maged, et al.; Modeling and Optimization of Compact Microwave Bandpass Filters; IEEE Transactions of Microwave Theory and Techniques; (Feb. 2008); pp. 420-430, vol. 56; No. 2.

Dupont, "Properties Handbook", Dupont, p. 4 (30 pgs.), Nov. 2003.

Trak Ceramics, "Dielectric Materials", Trak Ceramics, Inc., p. 1 (8 pgs).

* cited by examiner

MULTI-MODE FILTER

CROSS REFERENCE TO RELATED APPLICATIONS

The present application is related to and claims the benefit of Australian Provisional Patent Application No. 2011903389, filed Aug. 23, 2011 and U.S. Provisional Patent Application No. 61/531,277, filed Sep. 6, 2011, and is a Continuation-in-Part of both U.S. patent application Ser. No. 13/531,169, filed on Jun. 22, 2012, and U.S. patent application Ser. No. 13/531,084, filed on Jun. 22, 2012. All four of those disclosures are hereby incorporated by reference in their entirety into the present disclosure.

The present invention relates to filters, and in particular to a multi-mode filter including a resonator body for use, for example, in frequency division duplexers for telecommunication applications.

BACKGROUND

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

All physical filters essentially consist of a number of energy storing resonant structures, with paths for energy to flow between the various resonators and between the resonators and the input/output ports. The physical implementation of the resonators and the manner of their interconnections will vary from type to type, but the same basic concept applies to all. Such a filter can be described mathematically in terms of a network of resonators coupled together, although the mathematical topography does not have to match the topography of the real filter.

Conventional single-mode filters formed from dielectric resonators are known. Dielectric resonators have high-Q (low loss) characteristics which enable highly selective filters having a reduced size compared to cavity filters. These single-mode filters tend to be built as a cascade of separated physical dielectric resonators, with various couplings between them and to the ports. These resonators are easily identified as distinct physical objects, and the couplings tend also to be easily identified.

Single-mode filters of this type may include a network of discrete resonators formed from ceramic materials in a "puck" shape, where each resonator has a single dominant resonance frequency, or mode. These resonators are coupled together by providing openings between cavities in which the resonators are located. Typically, the resonators provide transmission poles or "zeros", which can be tuned at particular frequencies to provide a desired filter response. A number of resonators will usually be required to achieve suitable filtering characteristics for commercial applications, resulting in filtering equipment of a relatively large size.

One example application of filters formed from dielectric resonators is in frequency division duplexers for microwave telecommunication applications. Duplexers have traditionally been provided at base stations at the bottom of antenna supporting towers, although a current trend for microwave telecommunication system design is to locate filtering and signal processing equipment at the top of the tower to thereby minimise cabling lengths and thus reduce signal losses. However, the size of single mode filters as described above can make these undesirable for implementation at the top of antenna towers.

Multi-mode filters implement several resonators in a single physical body, such that reductions in filter size can be obtained. As an example, a silvered dielectric body can resonate in many different modes. Each of these modes can act as one of the resonators in a filter. In order to provide a practical multi-mode filter it is necessary to couple the energy between the modes within the body, in contrast with the coupling between discrete objects in single mode filters, which is easier to control in practice.

The usual manner in which these multi-mode filters are implemented is to selectively couple the energy from an input port to a first one of the modes. The energy stored in the first mode is then coupled to different modes within the resonator by introducing specific defects into the shape of the body. In this manner, a multi-mode filter can be implemented as an effective cascade of resonators, in a similar way to conventional single mode filter implementations. Again, this technique results in transmission poles which can be tuned to provide a desired filter response.

An example of such an approach is described in U.S. Pat. No. 6,853,271, which is directed towards a triple-mode mono-body filter. Energy is coupled into a first mode of a dielectric-filled mono-body resonator, using a suitably configured input probe provided in a hole formed on a face of the resonator. The coupling between this first mode and two other modes of the resonator is accomplished by selectively providing corner cuts or slots on the resonator body.

This technique allows for substantial reductions in filter size because a triple-mode filter of this type represents the equivalent of a single-mode filter composed of three discrete single mode resonators. However, the approach used to couple energy into and out of the resonator, and between the modes within the resonator to provide the effective resonator cascade, requires the body to be of complicated shape, increasing manufacturing costs.

Two or more triple-mode filters may still need to be cascaded together to provide a filter assembly with suitable filtering characteristics. As described in U.S. Pat. Nos. 6,853,271 and 7,042,314 this may be achieved using a waveguide or aperture for providing coupling between two resonator mono-bodies. Another approach includes using a single-mode combline resonator coupled between two dielectric mono-bodies to form a hybrid filter assembly as described in U.S. Pat. No. 6,954,122. In any case the physical complexity and hence manufacturing costs are even further increased.

SUMMARY OF INVENTION

According to a first aspect of the present invention, there is provided a multi-mode cavity filter, comprising: a dielectric resonator body incorporating a piece of dielectric material, the piece of dielectric material having a shape such that it can support at least a first resonant mode and a second substantially degenerate resonant mode; a conductive layer substantially covering the dielectric resonator body but having one or more apertures therein allowing access to the dielectric resonator body; and a coupling structure arranged in an aperture of the one or more apertures, comprising at least one coupling path for at least one of coupling an input signal to the first and second resonant modes and coupling an output signal from the first and second resonant modes, the coupling path having an open-circuit end located adjacent to an edge of the aperture for controlling a strength of electric field generated by the coupling structure.

In embodiments of the invention, the shape of the aperture can be altered from an otherwise regular shape by one or more deviations. For example, the conductive covering may further comprise a protrusion extending across the aperture towards the open-circuit end of the coupling path. The conductive layer may further comprise a recess in the edge of the aperture, extending away from the open-circuit end of the coupling path. The conductive layer may yet further comprise a recess surrounding, on two or more sides, the open-circuit end of the coupling path.

In embodiments of the present invention, the coupling path comprises a second open-circuit end located adjacent to a second edge of the aperture. The first open-circuit end may be located a first distance from the first edge of the aperture, and the second open-circuit end may be located a second distance from the second edge of the aperture, wherein the second distance is greater than the first distance. An electric field generated at the second open-circuit end may have a different magnitude and an opposite polarity to an electric field generated at the first open-circuit end. The coupling path may be electrically decoupled from the conductive layer. The first and second edges may be on opposite sides of the aperture.

In further embodiments of the invention, the coupling path comprises a conductive track.

In yet further embodiments of the invention, the aperture is formed in a face of the dielectric resonator body, and wherein the aperture has substantially the same shape as the face.

BRIEF DESCRIPTION OF THE DRAWINGS

For a better understanding of the present invention, and to show more clearly how it may be carried into effect, reference will now be made, by way of example, to the following drawings, in which.

DETAILED DESCRIPTION

Figure 1A:
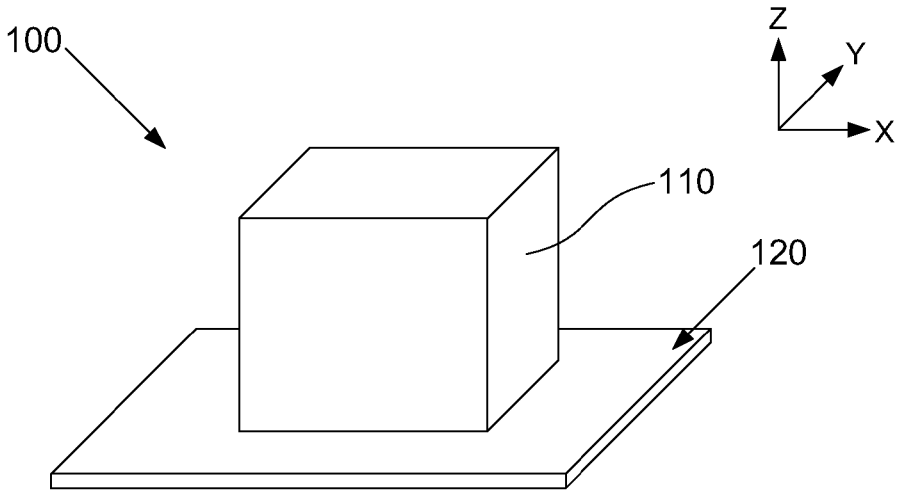
FIGS. 1A to 1E show a multi-mode filter according to embodiments of the invention.
Figure 1B:
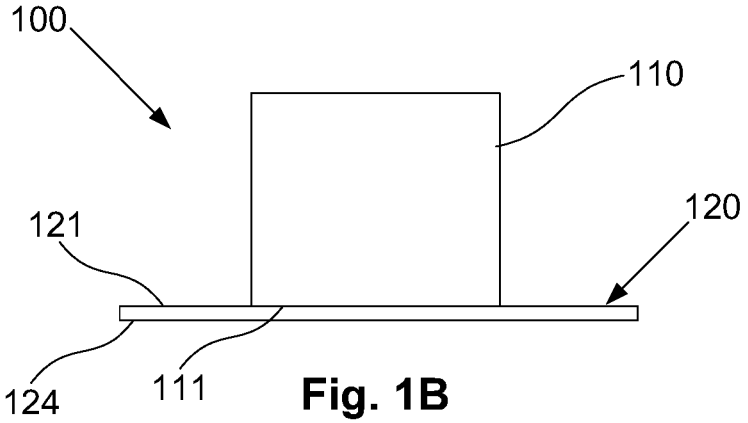
Figure 1C:
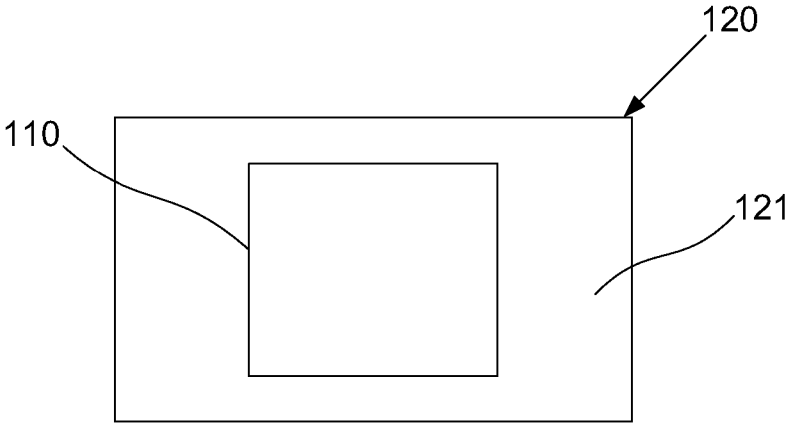

An example of a multi-mode filter will now be described with reference to FIGS. 1A to 1E.

In this example, the filter 100 includes a resonator body 110, and a coupling structure 130. The coupling structure 130 comprises at least one coupling path 131, 132, which includes an electrically conductive resonator path extending adjacent to at least part of a surface 111 of the resonator body 110, so that the coupling structure 130 provides coupling to a plurality of the resonance modes of the resonator body.

In use, a signal can be supplied to or received from the at least one coupling path 131, 132. In a suitable configuration, this allows a signal to be filtered to be supplied to the resonator body 110 for filtering, or can allow a filtered signal to be obtained from the resonator body, as will be described in more detail below.

The use of electrically conductive coupling paths 131, 132 extending adjacent to the surface 111 allows the signal to be coupled to a plurality of resonance modes of the resonator body 110 in parallel. This allows a simpler configuration of resonator body 110 and coupling structures 130 to be used as compared to traditional arrangements. For example, this avoids the need to have a resonator body including cut-outs or other complicated shapes, as well as avoiding the need for coupling structures that extend a precise distance into the resonator body. This, in turn, makes the filter cheaper and simpler to manufacture, and can provide enhanced filtering characteristics. In addition, the filter is small in size, typically of the order of 6000 $mm^3$ per resonator body, making the filter apparatus suitable for use at the top of antenna towers.

A number of further features will now be described.

In the above example, the coupling structure 130 includes two coupling paths 131, 132, coupled to an input 141 and an output 142, thereby allowing the coupling paths to act as input and output coupling paths respectively. In this instance, a signal supplied via the input 141 couples to the resonance modes of the resonator body 110, so that a filtered signal is obtained via the output 142. However, the use of two coupling paths is for the purpose of example only, and one or more coupling paths may be used depending on the preferred implementation.

For example, a single coupling path 131, 132 may be used if a signal is otherwise coupled to the resonator body 110. This can be achieved if the resonator body 110 is positioned in contact with, and hence is coupled to, another resonator body, thereby allowing signals to be received from or supplied to the other resonator body. Coupling structures may also include more coupling paths, for example if multiple inputs and/or outputs are to be provided, although alternatively multiple inputs and/or outputs may be coupled to a single coupling path, thereby allowing multiple inputs and/or outputs to be accommodated.

Alternatively, multiple coupling structures 130 may be provided, with each coupling structure 130 having one or more coupling paths. In this instance, different coupling structures can be provided on different surfaces of the resonator body. A further alternative is for a coupling structure to extend over multiple surfaces of the resonator body, with different coupling paths being provided on different surfaces, or with coupling paths extending over multiple surfaces. Such arrangements can be used to allow a particular configuration of input and output to be accommodated, for example to meet physical constraints associated with other equipment, or to allow alternative coupling arrangements to be provided. In use, a configuration of the input and output coupling paths 131, 132, along with the configuration of the resonator body 110 controls a degree of coupling with each of the plurality of resonance modes and hence the properties of the filter, such as the frequency response.

The degree of coupling depends on a number of factors, such as a coupling path width, a coupling path length, a coupling path shape, a coupling path position, a coupling path direction relative to the resonance modes of the resonator body, a size of the resonator body, a shape of the resonator body and electrical properties of the resonator body. A number of these factors will be described in greater detail below. It will therefore be appreciated that the example coupling structure and cube configuration of the resonator body is for the purpose of example only, and is not intended to be limiting.

The resonator body 110 includes an external coating of conductive material 114, such as silver, although other materials could be used such as gold, copper, or the like. The conductive material may be applied to one or more surfaces of the body. A region 116 of the surface adjacent to the coupling structure 130 may be uncoated to allow coupling of signals to the resonator body 110.

Figure 1D:
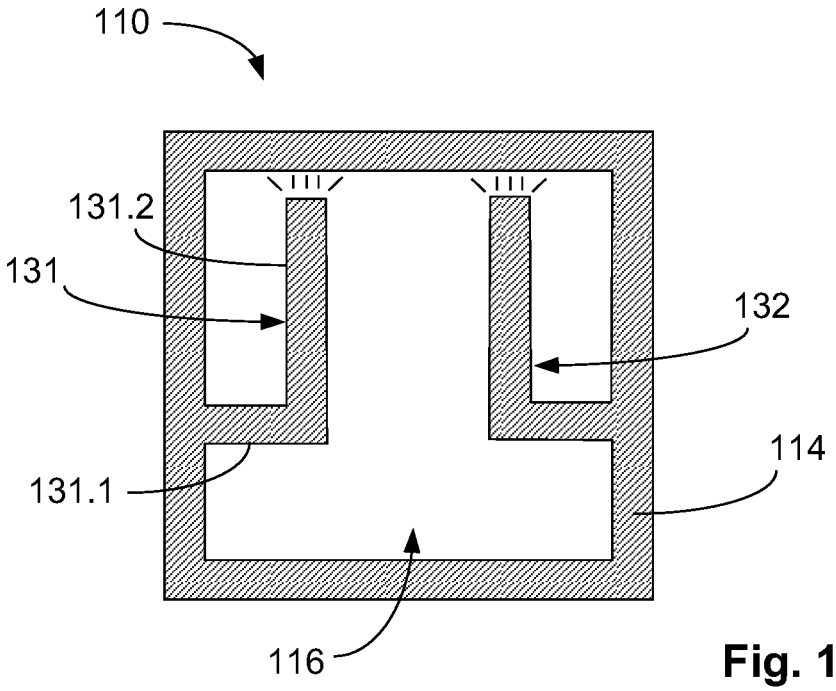
Figure 1E:
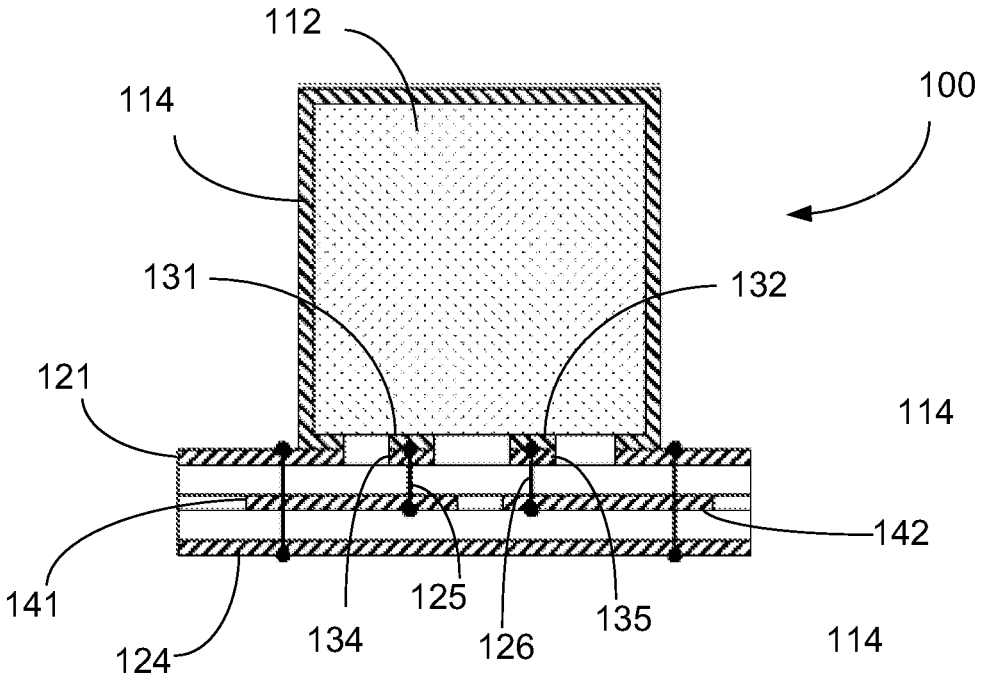

In the illustrated embodiment, the coupling structure 130 is provided on a surface of the dielectric resonator 112 directly, as shown in FIGS. 1D and 1E. That is, the resonator body 110 may be coated in a layer 114 of conductive material as described above; a coupling structure according to embodiments of the present invention can then be patterned into the layer of conductive material, and coupled to connection pads 134, 135 on an uppermost surface of the substrate 120. In that case, the coupling between the substrate 120 and the coupling structure on the resonator body may be provided by way of solder ball contacts or any other suitable means. The coupling structure can be formed using one of the standard techniques known to those skilled in the art, such as by patterning a mask (using printing techniques or photoresist) and then etching the exposed parts to create the coupling structure. Alternatively the coupling structure may be milled into the conductive layer surrounding the resonator body 110.

Alternatively, the coupling structure 130 may be provided on the substrate 120. In that case, the coupling structure can be formed in an upper conductive layer of the substrate using any of the standard techniques known to those skilled in the art, such as by patterning a mask in the layer (using printing techniques or photoresist) and then etching the exposed parts to create one or more cut-outs, or by milling the conductive layer.

The resonator body can be any shape, but generally defines at least two orthogonal axes, with the coupling paths extending at least partially in the direction of each axis, to thereby provide coupling to multiple separate resonance modes.

Figure 2A:
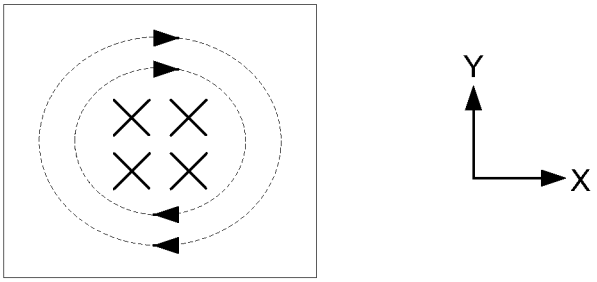
FIGS. 2A to 2C show resonant modes of a resonator body.
Figure 2B:
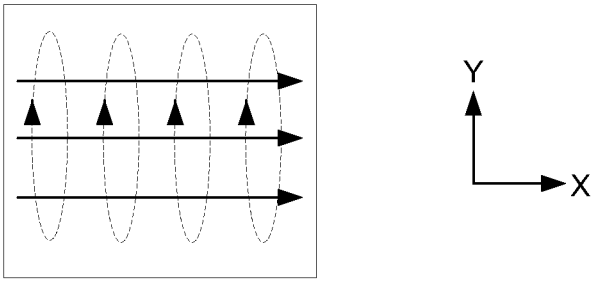
Figure 2C:
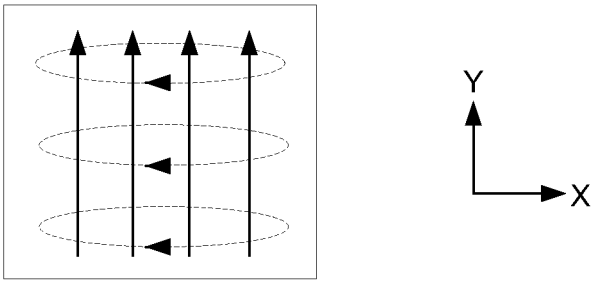

In the current example, the resonator body 110 is a cuboid body, and therefore defines three orthogonal axes substantially aligned with surfaces of the resonator body, as shown by the axes X, Y, Z. As a result, the resonator body 110 has three dominant resonance modes that are substantially orthogonal and whose electric fields are substantially aligned with the three orthogonal axes. Examples of the different resonance modes are shown in FIGS. 2A to 2C, which show magnetic and electrical fields in dotted and solid lines respectively, with the resonance modes being generally referred to as TM110, TE011 and TE101 modes, respectively.

Cuboid structures are particularly advantageous as they can be easily and cheaply manufactured, and can also be easily fitted together, for example by arranging multiple resonator bodies in contact. Cuboid structures typically have clearly defined resonance modes, making configuration of the coupling structure more straightforward. Additionally, the use of a cuboid structure provides a planar surface 111 so that the coupling structure 130 can be arranged in a plane parallel to the planar surface 111, with the coupling structure 130 optionally being in contact with the resonator body 110. This can help maximise coupling between the coupling structure 130 and resonator body 110, as well as allowing the coupling structure 130 to be more easily manufactured.

The provision of a planar surface 111 allows the substrate 120 to be a planar substrate, such as a printed circuit board (PCB) or the like. In the illustrated embodiment (see FIG. 1E in particular), the PCB substrate 120 has three layers. However, it will be apparent to those skilled in the art that the PCB 120 may comprise any number of further layers (for example, providing a power layer, or further ground layers) without departing from the scope of the present invention. Note that the phrase "number of layers" as used herein refers to the number of conductive layers as is the convention in the art. Each conductive layer is separated by a non-conductive layer of, for example, a material having low dielectric constant.

An uppermost layer (i.e. one of the outermost layers) of the PCB substrate 120 comprises a ground plane 121 having an aperture through which signals can be transferred to and/or from the resonator body 110. In the illustrated embodiment, the aperture in the substrate ground plane 121 substantially corresponds in size and shape to the aperture 116 in the conductive layer 114 covering the resonator body 110. In other embodiments, the aperture in the substrate ground plane 121 may correspond in shape to the aperture 116 in the conductive layer 114, but have a greater or smaller size. Connection pads 134, 135 (or, in alternative embodiments, the coupling structure 130 itself) are arranged within the aperture. These are electrically coupled by connections 125, 126 to the input and output connections 141, 142 in an inner signal layer such that signals can be passed to and from the resonator body 110. The connections 125, 126 may be standard vias or plated through-holes, as will be familiar to those skilled in the art. However, the input and output paths 141, 142 can be coupled to the coupling structure 130 using any suitable technique, such as capacitive or inductive coupling.

The bottom layer comprises a further ground plane 124, which is arranged so as to cover the aperture 116 as will be described in further detail.

The conductive layer 114 covering the resonator body 110 is electrically connected to the upper ground plane 121. Solder is suitable for this task as it provides both electrical and mechanical connection, but any other suitable connection mechanism may be employed. The upper ground plane 121 is further electrically coupled to the lower ground plane 124, which extends over the aperture 116 (albeit at a position removed from the aperture itself). In this manner, a near continuous ground plane is established around the dielectric resonator 112, and energy leakage from the filter 100 is reduced or minimized The conductive layer 114 surrounding the resonator 112 prevents energy from radiating out of the dielectric material from surfaces on which the conductive layer 114 is present. The electrical coupling between the upper and lower ground planes 121, 124 prevents energy from leaking out of the aperture 116, except of course the controlled extraction of energy by the coupling structure 130 corresponding to output signals.

The manner of the electrical coupling between the upper and lower ground planes 121, 124 may vary according to the frequencies of the input and output signals. That is, in one embodiment the upper and lower ground planes 121, 124 are coupled to each other by one or more electrical connections such as vias or plated through holes, as will be familiar to those skilled in the art. The electrical connections may be distributed so as to largely correspond with the boundary of the aperture 116. However, the number and type of such electrical connections, as well as their precise positioning, may be altered according to the frequencies of the signals which will be input to and/or output from the resonator body 110. If sufficient connections are used, based upon the frequencies present in the circuit, then the lower ground plane 124 forms the final (i.e. $6^{th}$ in the illustrated embodiment) conductive side to the resonator 'box'. This grounded, conductive, side acts as a reflector, in the same manner as the metallised sides of the resonator body 110. The electromagnetic energy is therefore kept within the structure and prevented from radiating outwards.

In alternative embodiments a ground plane may not be provided, in which case the coupling structure 130 could be formed from conductive material applied to the substrate 120. In this instance, the coupling structure 130 can still be electrically coupled to ground, for example through vias or other connections provided on the substrate.

The input or output may in turn be coupled to additional connections depending on the intended application. For example, the input and output paths 141, 142 could be connected to an edge-mount SMA coaxial connector, a direct coaxial cable connection, a surface mount coaxial connection, a chassis mounted coaxial connector, or a solder pad to allow the filter 100 to be directly soldered to another PCB, with the method chosen depending on the intended application. Alternatively the filter could be integrated into the PCB of other components of a communications system.

In use, the coupled resonance modes of the resonator body provide respective energy paths between the input and output. Furthermore, the input coupling path and the output coupling path can be configured to allow coupling therebetween to provide an energy path separate to energy paths provided by the resonance modes of the resonator body. This can provide four parallel energy paths between the input and the output. These energy paths can be arranged to introduce at least one transmission zero to the frequency response of the filter. In this regard, the term "zero" refers to a transmission minimum in the frequency response of the filter, meaning transmission of signals at that frequency will be minimal, as will be understood by persons skilled in the art.

As described above, the filtering performance of the filter 100 is dependent to a large degree on the coupling structure 130 (although other factors also play important roles). For example, particular shapes and orientations of the coupling structure may couple more strongly to one mode of resonance than the other modes. It is therefore important to design the coupling structures with care in order to maintain close control over the filter and to achieve a particular desired filtering performance. Embodiments of the present invention provide coupling structures and methods for designing coupling structures in which the degree of coupling using the electric field is controlled by placing an open-circuit end of the coupling structure adjacent to, but separated from an edge of the conductive covering 114. The open-circuit end is sufficiently close to the edge of the aperture to induce a corresponding opposite charge in the conductive layer. In this way, the electric field projecting into the resonator body 110 from the coupling structure is reduced because a corresponding charge is induced in the edge of conductive layer 114. The electric field is concentrated between the end of the coupling structure and the edge of the conductive covering 114, near the perimeter of the resonator body 110 and does not project into the resonator body 110 as far as it otherwise would. Example coupling structures will now be described with reference to FIGS. 1D and 3 to 6. It will be appreciated that, although illustrated on the resonator body 110, the coupling structures may alternatively be formed in the substrate 120 as described above.

FIG. 1D illustrates the underside of the resonator body 110, showing the window 116 and the coupling structure 130 according to embodiments of the present invention.

The window 116 comprises an aperture in the conductive layer 114 allowing access to the dielectric material. In one embodiment, the window 116 has a shape which is geometrically similar to the shape of the face of the resonator body 110 in which it is formed (that is, the window has the same shape but a different size). In the illustrated embodiment, where the resonator body 110 is cubic, the window 116 is therefore square. In other embodiments, the window 116 may have one or more deviations from this regular shape in order to achieve a particular filtering performance. Such deviations will be described in greater detail below.

The coupling structure 130 comprises an input coupling path 131 and an output coupling path 132. In the illustrated embodiment, these paths are mirror images of each other and lie on the same surface (face) of the resonator body 110, with a plane of symmetry running through the centre of the resonator body 110. However, it will be understood that in general the input and output coupling paths can have different shapes or be connected to different surfaces of the resonator body 110. In other embodiments, a single coupling path may be provided (i.e. to an input or an output). Only the input coupling path 131 will be described in detail here.

The input coupling path 131 comprises a track of conductive material having two components: a first portion 131.1 which connects the coupling path to the conductive covering 114 at the edge of the window 116; and a second portion 131.2 connected to the end of the connecting portion 131.1. The end of the second portion 131.2 is open-circuit (i.e. it is not electrically connected to anything). The first portion 131.1 extends substantially in the Y-direction, while the second portion 131.2 extends substantially in the X-direction.

In operation, an input signal is applied to the input coupling path 131, and current flows along the length of the coupling path. The current flow in the first portion 131.1 produces primarily a magnetic (H) field with the magnetic field lines running around the conducting path. The first portion 131.1 therefore couples primarily to the resonant mode of the resonator body 110 in the Y-direction. The current flow in the second portion 131.2 also produces primarily an H-field with the magnetic field lines running around the conducting path. The second portion 131.2 therefore couples primarily to the resonant mode of the resonator body 110 in the X-direction.

The end of the coupling path 131 is open circuit, and therefore no current flows in this part of the coupling path 131. The open-circuit end produces primarily an electric (E) field which extends in all directions, but its Z component is mainly what couples to the resonant mode of the resonator body 110 in the Z-direction. The X and Y components are not a good match to the X and Y mode E-field distributions and so do not couple strongly to those modes. Note also that the peak of the E-field is produced at the open-circuit end, but that E-field is also generated along the length of the coupling path 131 (decaying to zero at the connection with the grounded conductive covering 114).

The open-circuit end is located adjacent to (that is, close to but not touching) an edge of the window 116. This positioning has the effect of inducing (through capacitive effects) an equivalent charge at the edge of the window 116 and therefore reducing the extent of the electric field in the resonator body 110, as discussed above. This reduces the coupling to the Z mode of the resonator body and thus the overall filtering performance of the filter can be controlled. A number of small lines illustrate the the confinement of the E-field to the gap between the open circuit end and the conductive layer near the end of the coupling path 131.

In some circumstances, design constraints may prevent the end of the coupling path 131 being placed so close to the edge of the conventionally shaped window 116. For example, the length of the coupling path may be set so as to resonate at a particular frequency and therefore the designer may not wish to change this to extend the coupling path towards the edge of the window 116. Another constraint may be placed on the position of the coupling path relative to the resonator body 110 itself. For example, there may be some advantages in placing the coupling path 116 at the centre of the lower face of the resonator body 116.

Figure 3:
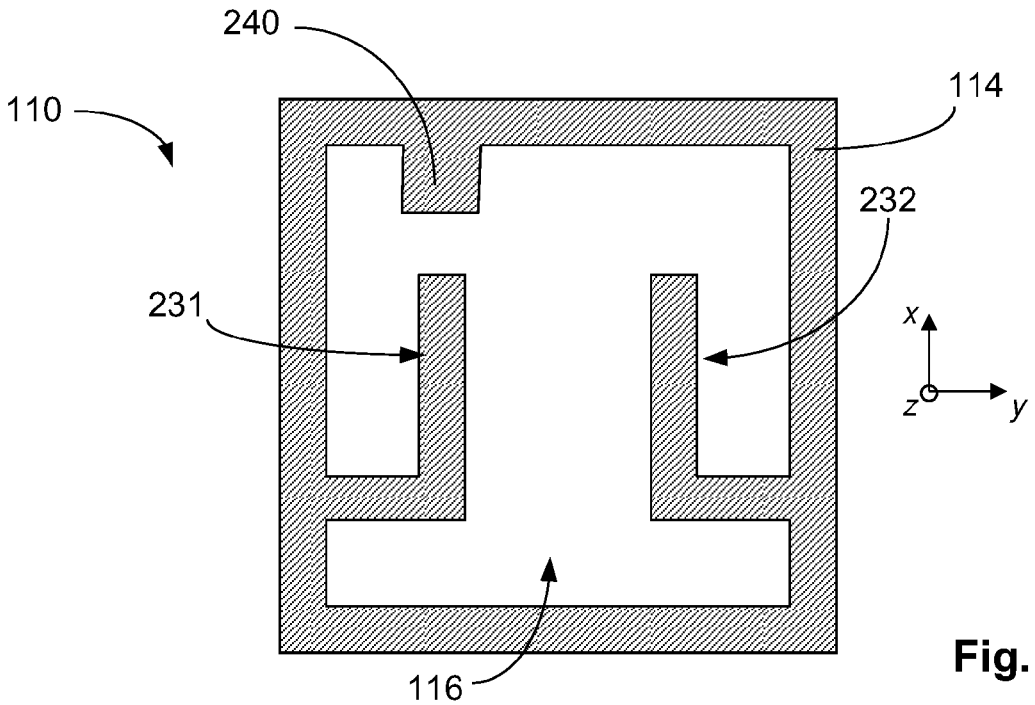
FIGS. 3 to 6 show coupling structures according to embodiments of the invention.
Figure 4:
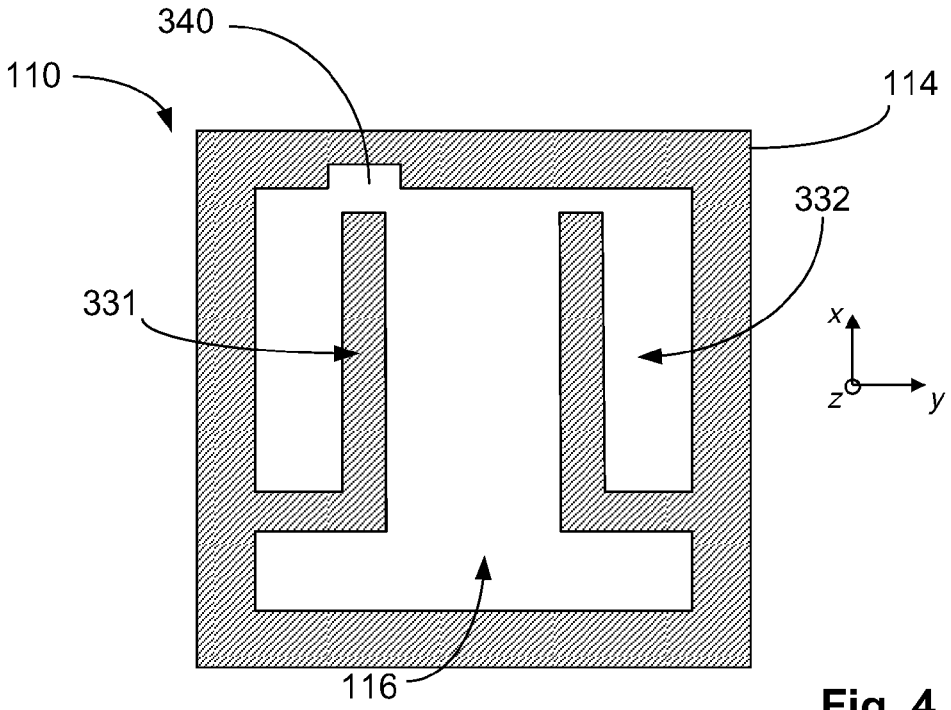
Figure 5:
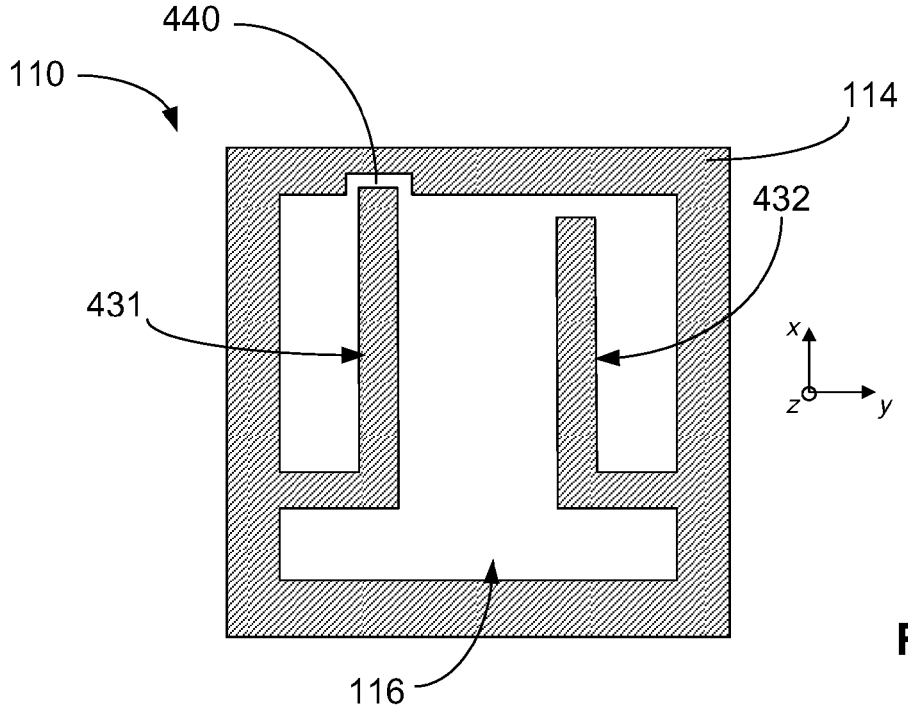

FIGS. 3 to 5 show coupling structures which address these issues. Similar features are labelled with similar reference numerals for simplicity. For example, the resonator body is labelled "110" and the window labelled 116 throughout.

FIG. 3 shows a coupling structure comprising an input coupling path 231 and an output coupling path 232. Again, both are identical and minor images of each other; however, this need not be the case. Only the input coupling path 231 will be described in detail, but it will be understood that the principles apply equally to output coupling paths.

In this instance, the input coupling path 231 is located at the centre of the window 116, and its length is carefully chosen so as to achieve a filtering performance at a desired wavelength. For example, the input coupling path 231 may have a length (measured from its connection to the conductive layer 114 to the open-circuit end) equal to a quarter wavelength of the design wavelength of the filter 100. Thus the designer may prefer not to increase the length of the coupling path 231 or move it from the centre of the window 116 in order to reduce the coupling to the Z mode.

To overcome this problem, a protrusion 240 is formed in an edge of the window 116. The protrusion 240 is part of the conductive layer 116 and extends across the window 116, effectively altering its shape, towards the open-circuit end of the coupling path 231. In the illustrated embodiment, the protrusion 240 is located "in line" with the coupling path 231 (i.e. in the X-direction), but equally could be placed to the side of the coupling path. In this way, the distance between the open-circuit end of the input coupling path 231 and the conductive layer at the side of the window 116 is reduced, the E-field is concentrated at the end of the input coupling path, also in turn reducing the Z mode coupling.

FIG. 4 shows a further coupling structure in which it is desired to increase the coupling to the Z mode. Again, the coupling structure comprises an input coupling path 331 and an output coupling path 332. In this case, however, the open-circuit end of the coupling path is too close to the edge of the window 116 to achieve the desired level of coupling to the Z mode.

The filter 100 thus further comprises a recess 340 in the edge of the window 116, i.e. a concave shape which effectively increases the distance between the conductive layer 114 and the open-circuit end of the coupling path 331. The recess 340 therefore represents a deviation from the otherwise regular shape of the window 116, but results in an increased coupling to the Z mode without moving the coupling path or changing its length.

FIG. 5 shows a further coupling structure according to embodiments of the present invention. This embodiment is similar to that described above with respect to FIG. 4, but for the open-circuit end of the coupling path (ref 431 in FIG. 5) being located within the recess 440 at the edge of the window 116. Rather than increasing the Z mode coupling as with the embodiment of FIG. 4, therefore, the Z mode coupling is strongly reduced in this embodiment as the open-circuit end is partially surrounded by the ground plane of the conductive layer 114. This strongly localizes the E-field at the end of the coupling path 431, strongly reduces the E-field extent within the resonator body 110 and strongly reduces the coupling to the Z mode.

Figure 6:
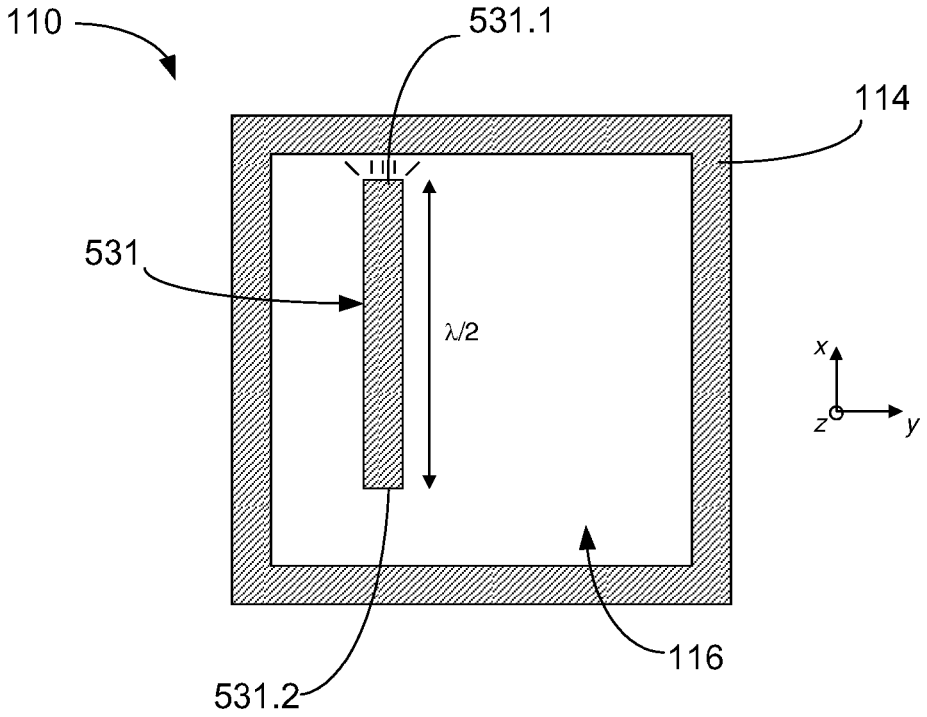

FIG. 6 shows a coupling structure according to further embodiments of the present invention. Only a single coupling path 531 is illustrated for clarity, and this could therefore be used to couple an input signal to the resonator body 110 or to couple an output signal from the resonator body 110.

The coupling path 531 is electrically decoupled from the conductive layer (i.e. the edge of the window 116) and therefore has two ends 531.1, 531.2 which are both open circuit. In the illustrated embodiment the coupling path 531 has a length which is equal to half the wavelength of a desired filtering frequency so as to resonate particularly at that frequency (via a standing wave, with nodes at either end 531.1, 531.2). As both ends are open circuit, electric fields are generated at both ends of the coupling path and, at any one time, these electric fields will have opposite polarities. One electric field therefore cancels the other and, were these electric fields identical in size, complete cancellation would result leading to substantially zero coupling to the Z-mode. In order to control the Z mode coupling without complete cancellation, therefore, the coupling path 531 is arranged so that one open-circuit end 531.1 is located closer to the edge of the window 116 than the other open-circuit end 531.2. The E-field at the first open-circuit end 531.1 is therefore less than the E-field at the second open-circuit end 531.2 and the cancellation due to their opposite polarities is no longer total, but partial. Thus some degree of Z mode coupling takes place due to the non-zero E-field.

In the illustrated embodiment, the ends 531.1, 531.2 are located at differing distances from the edges of the window by virtue of an offset coupling path 531. That is, the geometric centre of the coupling path 531 is placed at a location which is away from the geometric centre of the face of the resonator body 110. This non-central position also affects the degree of Z-mode coupling via a different mechanism to the one described above. For example, if we ignored the differing E-fields at either end of the coupling path, and instead assumed that the E-field at either end was of equal and opposite magnitude, then the Z mode of the resonator body 110 will have an E-field with a cosine variation across its base (i.e. in the X direction). If the coupling path 531 is placed centrally then, by symmetry, each end 531.1, 531.2 will have equal and opposite coupling to the Z mode. However, if the coupling path 531 is displaced from the centre of the resonator body 110 face (as in the illustrated embodiment) then one end will see a more localized E-field than the other and so will couple less strongly to the Z mode. Thus the degree of Z mode coupling can be controlled by appropriate positioning of the coupling path 531 away from the centre of the resonator body 110 face.

In other embodiments, the degree of Z mode coupling can be varied without displacing the coupling path 531 from the centre of the resonator body 110 face. For example, by positioning a protrusion or a recess (as described above with respect to FIGS. 3 to 5) close to one end of the coupling path 531, the E field at that end can be varied and thereby the degree of coupling to the Z mode.

Note that, in the illustrated example, the two ends 513.1, 531.2 are not adjacent to the same edges of the window (in fact they are adjacent to opposite sides of the window 116); however, in alternative embodiments both ends may be adjacent to the same edge of the window.

Embodiments of the present invention therefore provide a multi-mode cavity filter with a resonator body and a coupling structure for coupling an input signal to the resonator body and/or for coupling an output (i.e. filtered) signal from the resonator body 110. The resonator body 110 is substantially covered by a layer of conductive material in order to minimize leakage of energy outside the body, but has at least one aperture in which the coupling structure is placed, to allow access to the resonator body 110. The degree of coupling (particularly to the Z mode) can be controlled by appropriate positioning of the end of a coupling path of the coupling structure, adjacent to an edge of the aperture in which the coupling structure is placed. In further embodiments, the window may have a protrusion or a recess (representing a deviation from an otherwise regular shape) so as to vary the degree of Z mode coupling. In yet further embodiments, the coupling path may have more than one open-circuit end, producing electric fields of non-equal magnitude but opposite polarities, such that the electric field of one end partially cancels the electric field of the other end.

Those skilled in the art will appreciate that various amendments and alterations can be made to the embodiments described above without departing from the scope of the invention as defined in the claims appended hereto.

The invention claimed is:

1. A multi-mode cavity filter comprising:

a dielectric resonator body incorporating a piece of dielectric material, the piece of dielectric material being free of cutouts and holes for coupling probes and having a shape supporting at least a first resonant mode and a second substantially degenerate resonant mode;

a conductive layer substantially covering the dielectric resonator body but having one or more apertures therein allowing access to a surface of the dielectric resonator body; and a coupling structure arranged in an aperture of the one or more apertures, said coupling structure being on or contacting the surface of the dielectric resonator body, said coupling structure comprising at least one coupling path for at least one of coupling an input signal to the first and second resonant modes and coupling an output signal from the first and second resonant modes, the coupling path having an open-circuit end located adjacent to an edge of the aperture for controlling a strength of electric field generated by the coupling structure, wherein the open-circuit end is a first open-circuit end, wherein the edge of the aperture is a first edge of the aperture, and wherein the coupling path comprises a second open-circuit end located adjacent to a second edge of the aperture, and wherein the first open-circuit end is located a first distance from the first edge of the aperture, wherein the second open-circuit end is located a second distance from the second edge of the aperture, and wherein the second distance is greater than the first distance.

2. The multi-mode cavity filter according to claim 1, wherein the conductive layer comprises a recess surrounding, on two or more sides, the open-circuit end of the coupling path.

3. The multi-mode cavity filter according to claim 1, wherein a first electric field portion generated at the first open-circuit end has a different magnitude from a second electric field portion generated at the second open-circuit end.

4. The multi-mode cavity filter according to claim 1, wherein the coupling path is electrically decoupled from the conductive layer.

5. The multi-mode cavity filter according to claim 4, wherein a first electric field portion generated at the first open-circuit end is in an opposite direction from a second electric field portion generated at the second open-circuit end.

6. The multi-mode cavity filter according to claim 1, wherein the first and second edges are on opposite sides of the aperture.

7. The multi-mode cavity filter according to claim 1, wherein the coupling path comprises a conductive track.

8. The multi-mode cavity filter according to claim 1, wherein the aperture is formed in the conductive layer on a face of the dielectric resonator body, and wherein the aperture has substantially the same shape as the face.

9. A multi-mode cavity filter comprising:

a dielectric resonator body incorporating a piece of dielectric material, the piece of dielectric material having a shape supporting at least a first resonant mode and a second substantially degenerate resonant mode;

a conductive layer substantially covering the dielectric resonator body but having one or more apertures therein allowing access to the dielectric resonator body; and a coupling structure arranged in an aperture of the one or more apertures, comprising at least one coupling path for at least one of coupling an input signal to the first and second resonant modes and coupling an output signal from the first and second resonant modes, the coupling path having an open-circuit end located adjacent to an edge of the aperture for controlling a strength of electric field generated by the coupling structure, wherein the conductive layer further comprises a protrusion extending across the aperture towards the open-circuit end of the coupling path.

10. A multi-mode cavity filter comprising:

a dielectric resonator body incorporating a piece of dielectric material, the piece of dielectric material having a shape supporting at least a first resonant mode and a second substantially degenerate resonant mode;

a conductive layer substantially covering the dielectric resonator body but having one or more apertures therein allowing access to the dielectric resonator body; and a coupling structure arranged in an aperture of the one or more apertures, comprising at least one coupling path for at least one of coupling an input signal to the first and second resonant modes and coupling an output signal from the first and second resonant modes, the coupling path having an open-circuit end adjacent to an edge of the aperture for controlling a strength of electric field generated by the coupling structure, wherein the conductive layer comprises a recess in the edge of the aperture, extending away from the open-circuit end of the coupling path.

11. A multi-mode cavity filter comprising:

a dielectric resonator body incorporating a piece of dielectric material, the piece of dielectric material being free of cutouts and holes for coupling probes and having a shape such that it can support at least a first resonant mode and a second substantially degenerate resonant mode;

a conductive layer substantially covering the dielectric resonator body but having one or more apertures therein allowing access to a surface of the dielectric resonator body; and a coupling structure arranged in an aperture of the one or more apertures, said coupling structure being on or contacting the surface of the dielectric resonator body, said coupling structure comprising at least one coupling path for at least one of coupling an input signal to the first and second resonant modes and coupling an output signal from the first and second resonant modes, the coupling path having an open-circuit end located adjacent to an edge of the aperture for controlling a strength of electric field generated by the coupling structure, wherein the open-circuit end is a first open-circuit end, wherein the edge of the aperture is a first edge of the aperture, and wherein the coupling path comprises a second open-circuit end located adjacent to a second edge of the aperture, wherein the coupling path is electrically decoupled from the conductive layer, and wherein a first electric field portion generated at the first open-circuit end is in an opposite direction from a second electric field portion generated at the second open-circuit end.

12. The multi-mode cavity filter according to claim 11, wherein the conductive layer comprises a recess surrounding, on two or more sides, the open-circuit end of the coupling path.

13. The multi-mode cavity filter according to claim 11, wherein the first open-circuit end is located a first distance from the first edge of the aperture, wherein the second open-circuit end is located a second distance from the second edge of the aperture, and wherein the second distance is greater than the first distance.

14. The multi-mode cavity filter according to claim 13, wherein the first electric field portion generated at the first open-circuit end has a different magnitude from the second electric field portion generated at the second open-circuit end.

15. The multi-mode cavity filter according to claim 11, wherein the first and second edges are on opposite sides of the aperture.

16. The multi-mode cavity filter according to claim 11, wherein the coupling path comprises a conductive track.

17. The multi-mode cavity filter according to claim 11, wherein the aperture is formed in the conductive layer on a face of the dielectric resonator body, and wherein the aperture has substantially the same shape as the face.

* * * * *